United States Patent [19]

Whitley, Jr.

[11] 4,037,421

[45] July 26, 1977

[54] FLOAT-ON BOAT DOCKING AND LIFTING ASSEMBLY

[76] Inventor: William P. Whitley, Jr., 3001 Industrial Ave. No. 3, Fort Pierce, Fla. 33450

[21] Appl. No.: 753,549

[22] Filed: Dec. 22, 1976

[51] Int. Cl.[2] ..... B63C 3/06

[52] U.S. Cl. ..... 61/65; 114/44

[58] Field of Search ..... 114/44, 45, 263; 61/64, 61/65

[56] References Cited

U.S. PATENT DOCUMENTS

| | | | |
|---|---|---|---|
| 3,077,742 | 2/1963 | Brown | 61/65 |
| 3,221,899 | 12/1965 | Gronlund | 61/64 X |
| 3,265,024 | 8/1966 | Kramlich | 114/45 |
| 3,504,502 | 4/1970 | Blount | 61/65 |
| 3,857,248 | 12/1974 | Rutter | 114/45 X |

*Primary Examiner*—Trygve M. Blix
*Assistant Examiner*—Gregory W. O'Connor

[57] ABSTRACT

A float-on boat lift for pleasure craft has a substantially rectangular, open-ended support framework adapted to project outwardly of a dock facility or seawall, within which framework is pivotally secured, at one end, a float-on boat cradle. Winch mechanism supported at the inner end of the cradle framework and at approximately dock level includes cables extending along each side of the cradle framework serving to raise and lower the rearward end thereof out of and into the water for dry docking or launching of a boat previously floated thereupon while in its lowered position. The cradle comprises lateral guides and bottom chocks distributed along its length to facilitate the loading and seating thereon of a boat preparatory to its being lifted out of the water.

10 Claims, 5 Drawing Figures

FLOAT-ON BOAT DOCKING AND LIFTING ASSEMBLY

This invention relates to dry docking and is directed particularly to a float-on boat docking and lifting assembly particularly suitable for use in the lifting and lowering of small pleasure boats in the range from about 12 feet to 36' feet in length.

Various mechanisims have heretofore been devised for the lifting and lowering of pleasure boats into and out of the water for simplified dry-docking. Such prior devices, however, are deficient in various respects, principally in that they are complicated in construction and expensive to manufacture and install. For this reason, they have gained only very limited acceptance by pleasure boat owners, particularly as applied to use with smaller boats. It is, accordingly, the principal object of this invention to provide a simplified and improved dry-docking system and apparatus for pleasure boats that obviates the deficiencies of small boat dry-docking apparatus heretofore known.

It is a more particular object of the invention to provide a pleasure boat float-on docking and lifting assembly of the character above-described which requires no superstructure for support of the lifting mechanism, and wherein the lifting winch and drive mechanism is located at approximately dock level at the front of the cradle framework for ease of operation in lifting and lowering the boat.

Another object of the invention is to provide a float-on boat docking and lifting assembly of the character described wherein the lifting mechanism comprises a cradle adapted to be pivotally submerged at the rear end for float-on reception thereupon of a boat to be lifted, and comprising guide and chock means along its length for facilitating the loading and seating thereupon of the boat prior to the lifting and upward swinging of the cradled boat out of the water.

Yet another object of the invention is to provide a float-on boat docking and lifting assembly of the above nature which is well adapted to prefabrication in kit form for assembly and installation at the dock site, and which will be of such simple construction as permits installation without difficulty, even by unskilled workmen.

Yet another object of the invention is to provide a float-on boat docking and lifting assembly which will be inexpensive to manufacture, dependable in operation and long-wearing in use.

Other objects, features and advantages of the invention will be apparent from the following description when read with reference to the accompanying drawings. In the drawings, wherein like reference numerals denote corresponding parts throughout the several views.

Figure 2:
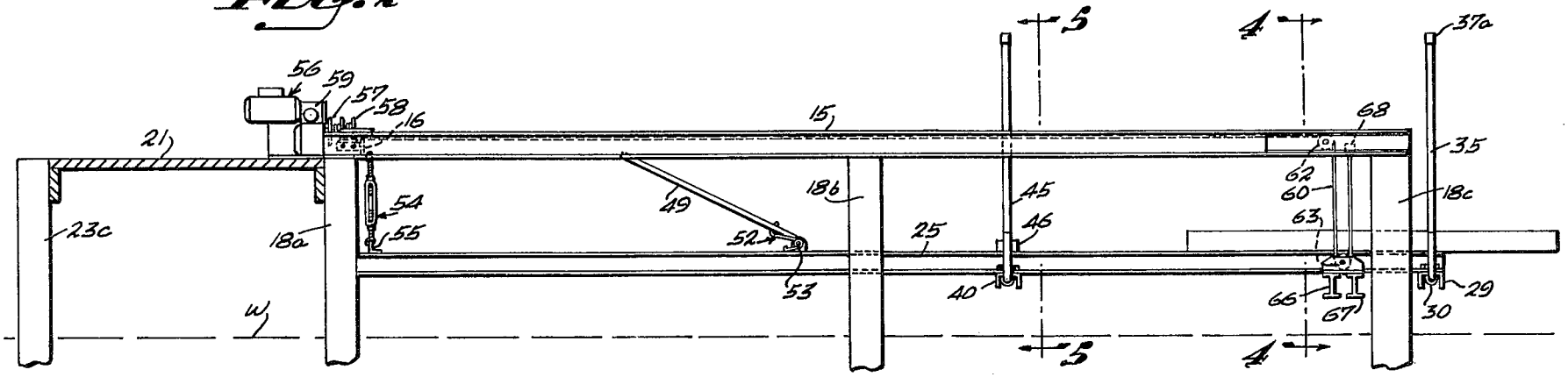
FIG. 2 is a side elevational view of the float-on boat assembly taken along the line 2—2 of FIG. 1 in the direction of the arrows, the lifting cradle being illustrated in withdrawn position, out of the water.
Figure 4:
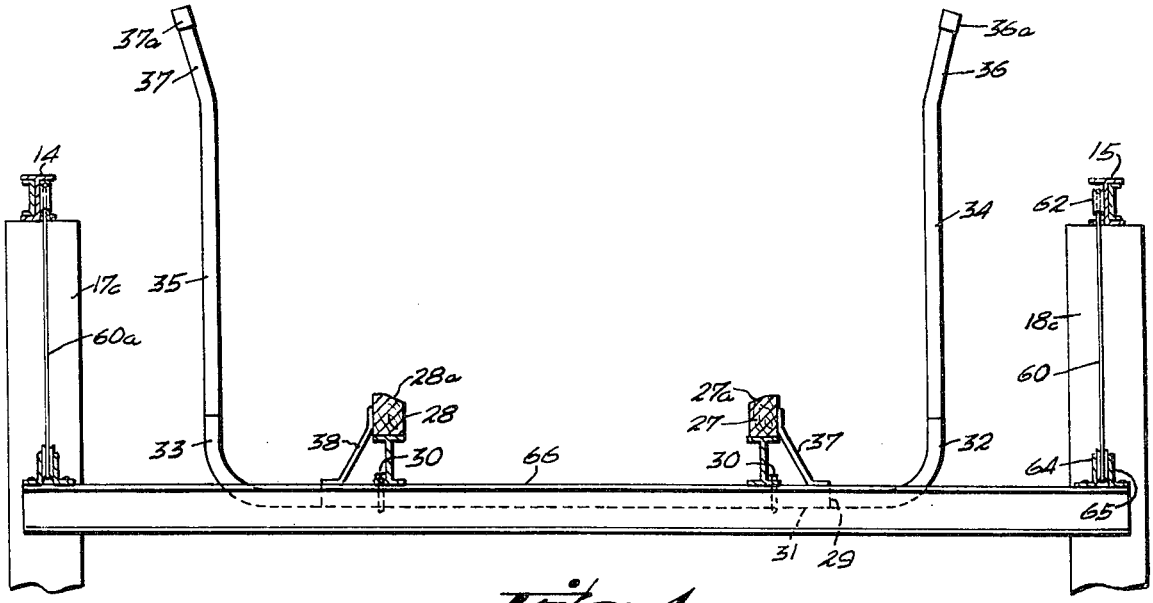
Figure 5:
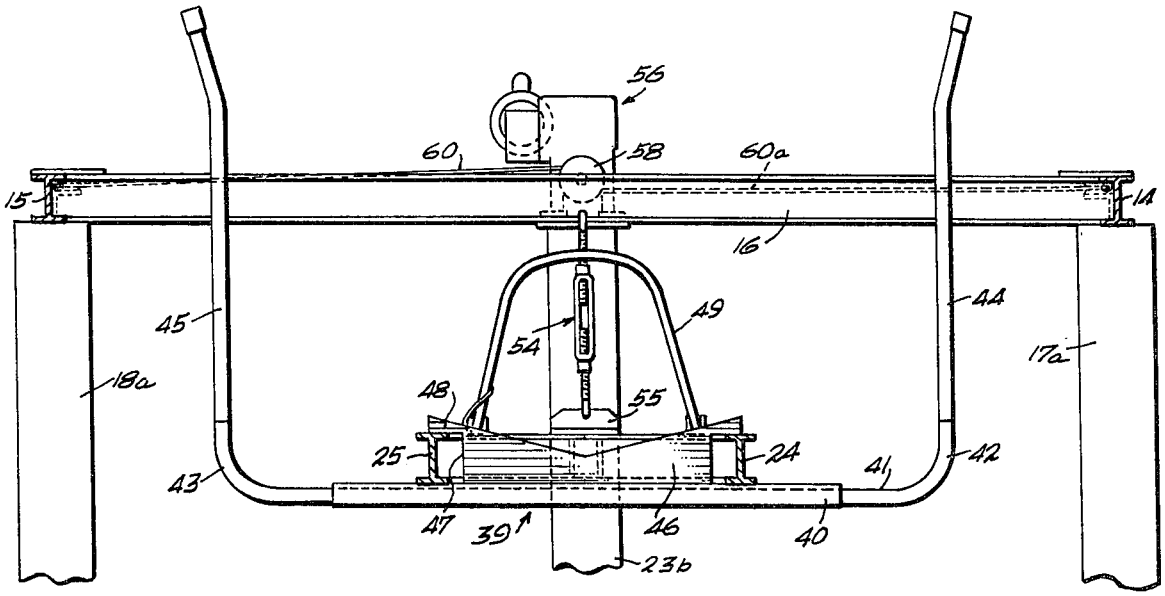

FIG. 4 is a transverse vertical cross-sectional view taken along the line 4—4 of FIG. 2 in the direction of the arrows and illustrating constructional details of the lift cradle and its supporting framework; and FIG. 5 is a transverse vertical cross-sectional view taken along the line 5—5 of FIG. 2 in the direction of the arrows and further illustrating construction details of the lift cradle and its supporting framework.

Figure 1:
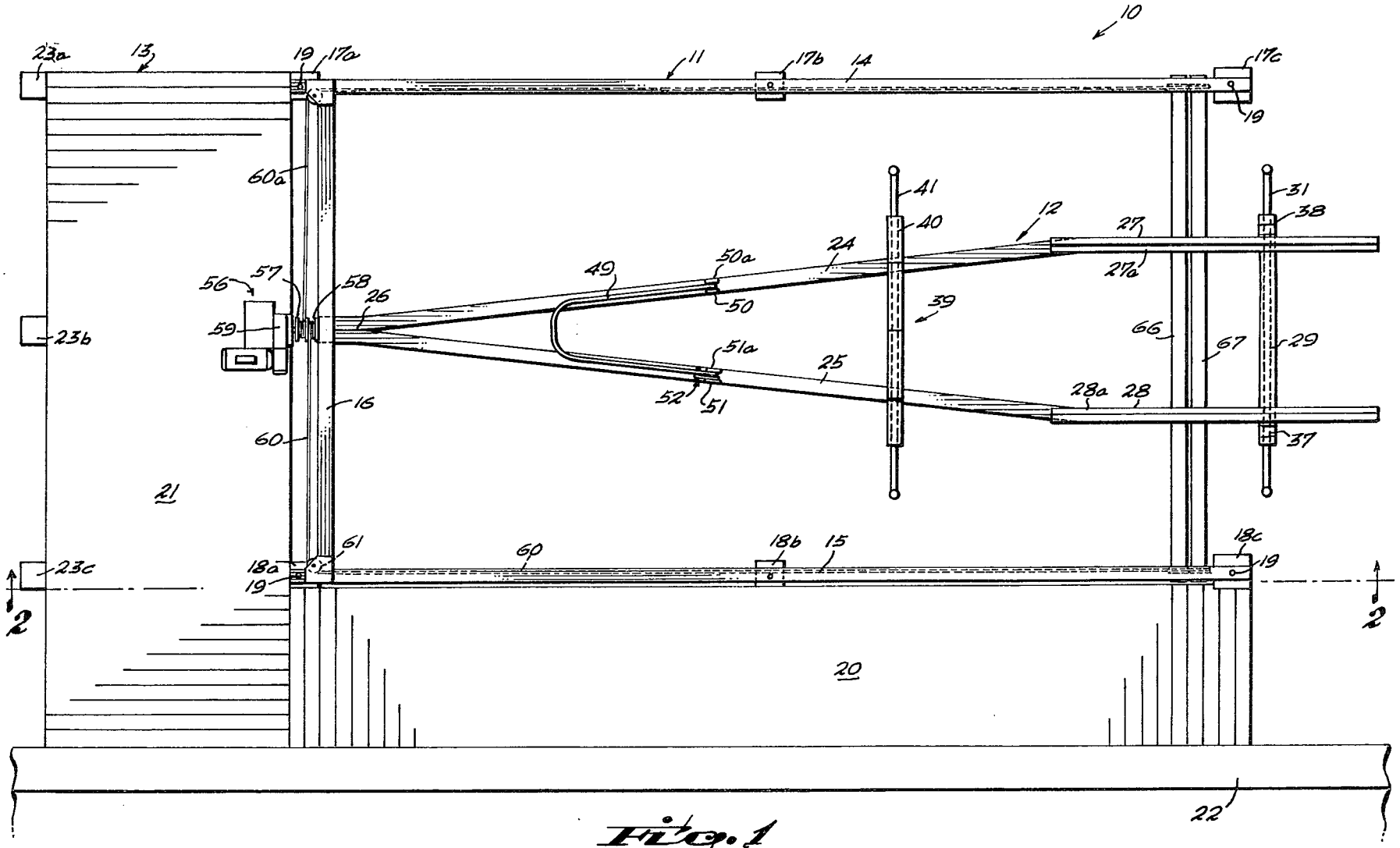
FIG. 1 is a plan view of the float-on boat docking and lifting assembly.

Referring now in detail to the drawings, reference numeral 10 designates, generally, a float-on boat docking and lifting assembly embodying the invention, the same comprising a cradle support framework 11, a boat cradle 12, and an L-shaped dock 13 within the inner corner of which said support framework and cradle is assembled for convenient use of the boat lift. As best illustrated in FIGS. 1 and 2, the cradle support framework 11 is rectangular in shape, comprising spaced, parallel, longitudinal I-beam members 14, 15 and transverse front I-beam member 16 interjoining front end portions of said longitudinal I-beam members. As illustrated in FIGS. 1, 2, 4 and 5, the cradle support framework members 14, 15 and 16, are supported upon square piling members, three spaced piling members **17*a*, 17*b* and 17*c* being used for support of I-beam member 14, and three spaced piling members 18*a*, 18*b* and 18*c* being used for support of I-beam member 15. The piling members 17*a*, 17*b* and 17*c* and 18*a*, 18*b* and 18*c* will preferably be formed of reinforced concrete, square in cross-section, with the size of the rear or outer end piling members 17*c* and 18*c* preferably being of increased cross-sectional size to accomodate the greater weight imposed thereon upon loading and unloading of a boat, as in hereinafter more particularly described. The upper end of the piling members 17*a*, 17*b* and 17*c* and 18*a*, 18*b* and 18*c* tie in a common horizontal plane for supporting cradle support framework 11 horizontally thereupon with suitable bolts, indicated generally at 19**.

The L-shaped deck 13 comprises a longitudinally-extending wooden walk-way 20 and an outwardly-extending walk-way 21 against which the front end of the cradle support framework 11 abuts. The longitudinally-extending walk-way 20 may be secured between sea wall 22, for example, and piling members **18*a*, 18*b* and 18*c* by appropriate understructure, not illustrated. The outwardly-extending wooden walk-way 21 may similarly be supported by the sea wall 20, piling members 17*a*, and 18*a*, additional piling members 23*a*, 23*b* and 23*c* provided for this purpose, and appropriate understructure. Since the L-shaped deck 13** serves no purpose other than for surface access to the float-on boat lift, and forms no part of the invention herein claimed, a more detailed description thereof is not deemed to be necessary herein for a full understanding of the invention.

The boat cradle 12 comprises a pair of laterally-spaced, longitudinal framework I-beams 24, 25 which converge at the forward end whereat they are secured to one another with bracket 55, as indicated at 26. The rear ends of the cradle framework I-beams 24, 25 have secured thereupon, further rearwardly-extending spaced, parallel wooden chock members 27, 28. As best illustrated in FIGS. 1 and 4, the wooden chock members 27, 28 have inner, opposed portions of the upper ends thereof beveled along their lengths, as indicated at **27*a*, 28*a*, respectively, to provide appropriately inclined seating surfaces for boats supported upon the cradle, as is hereinafter more particularly described. The undersides of the I-beams 24, 25, near the outer ends thereof, have secured thereagainst, as by bolting, a pair of closely-spaced, transversely-extending brace members 66**, 67, said brace members extending equidistantly outwardly of each side of said longitudinal I-beam members to accommodate cradle lifting mechanism, as is hereinafter more particularly described.

Transversely secured to and between the terminal rear end portions of the cradle framework I-beams 24, 25 is a U-channel member 29, the open side of which faces downwardly. Secured within the recess defined by the U-shaped channel member 29 as by U-bolts 30, is a shallow, U-shaped, tubular member 31, the outer ends of which are directed upwardly at each side of the cradle framework, as indicated at 32 and 33, whereat they join with respective upstanding tubular guide posts 34 and 35. As illustrated in FIG. 4, short upper end portions of the tubular guide posts 34, 35 are bent slightly outward to each side, as indicated at 36 and 37. Cylindrical caps **36*a*, 37*a*, preferably formed of a synthetic plastic material, are friction-fitted and pinned over the upper ends of each of the tubular guide posts 34, 35. As further illustrated in FIG. 4, annular brace members 37, 38 extend between upper outer end portions of the U-channel member 29 and outer surface portions of the wooden chock members 27, 28** to provide additional support therefor, said brace members being secured to said channel member as by bolting, and to said wooden chock members as by through bolts (not illustrated).

As illustrated in FIGS. 1, 2 and 5, the cradle framework I-beam members 24 and 25 are also provided, midway along their lengths, with a second boat guide and chock assembly, indicated generally at 39. The boat guide chock assembly 39 comprises a U-channel member 40 and tubular member 41 having upwardly-extending ends 42, 43 to which are affixed tubular guide posts 44, 45 which may be identical with the guide posts 34, 35 comprising the above-described boat guide mechanism at the rear end of the cradle framework. Supported upon and secured to an upper surface portion of the U-channel member 40 between the cradle framework I-beam members 24, and 25 is a V-block member 46 the ends of which, at their undersides, are cut or otherwise formed with angular recesses 47 defining shoulders 48 which seat upon respective ones of said I-beam members.

As best illustrated in FIGS. 1 and 2, there is pivotally affixed to the cradle framework I-beams 24, 25, between the front end thereof and the boat guide and chock assembly 39, a generally U-shaped, forwardly and upwardly-extending bow stop member 49. The pivoted ends of the bow stop member 49 will preferably be journaled between pairs of upstanding brackets **50, 50*a* and 51, 51*a* fixed to the respective framework I-beams 24, 25; and a torsion spring 52 (see FIG. 2) circumjacent, the journal pin 53 carried by brackets 51, 51*a* and acting between the I-beam member 25 and the bow stop member 49** at one side thereof, serves to resiliently constrain said bow stop member in the clockwise or upward direction.

As is hereinafter more particularly described, the bow stop member 49, the boat guide and chock assembly 39 and the tubular guide posts 34, 35 at the rear of the boat cradle 12, together with the wooden longitudinal chock members 27, 28 at the rear of the boat cradle, serve to guide position a boat to be supported for loading and unloading upon use of the float-on boat lift.

Means is provided for pivotally supporting the forward end of the boat cradle in vertically adjustable position with respect to the inner end of the cradle support framework 11. To this end, a turn-buckle 54 is linked between the front I-beam member 16 at a central position therealong and a bracket 55 fixed upon the forward end of the boat cradle 12 straddling front end portions of the I-beam members 24, 25 thereof. It will be understood that the distance between the front end of the boat cradle 12 and the cradle support framework 11 can be adjusted to accommodate to different water levels, indicated by way of example at W, by appropriate adjustment of the turn-buckle.

Figure 3:
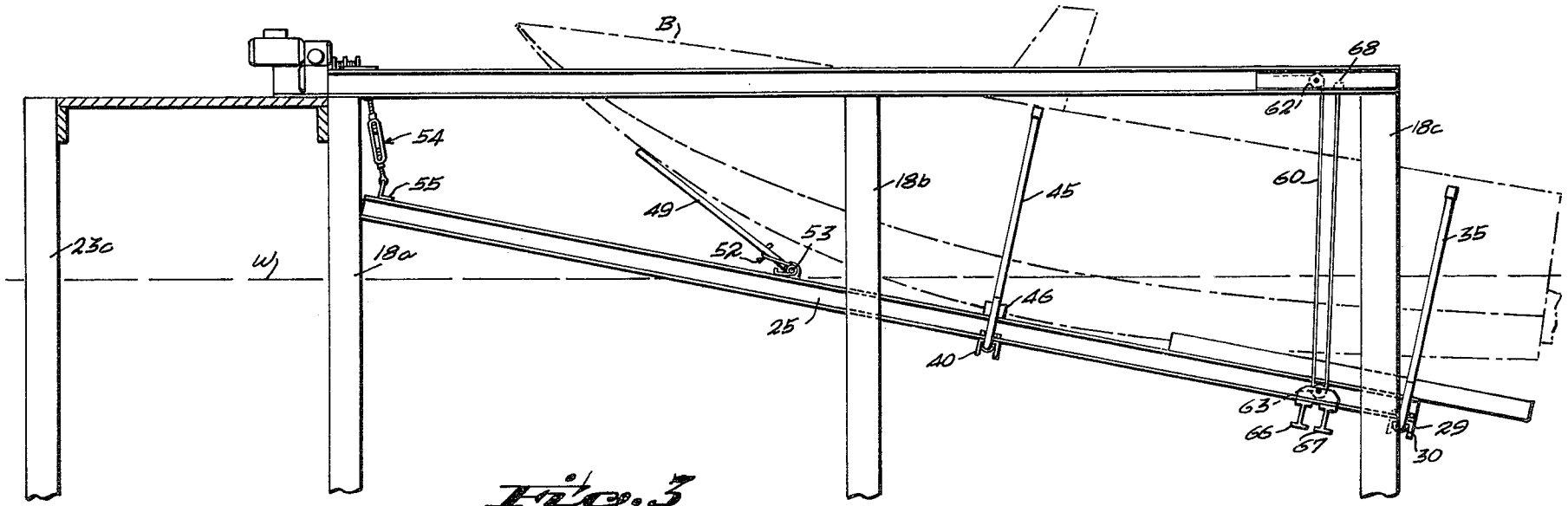
FIG. 3 is a vertical cross-sectional view similar to that of FIG. 2 but illustrating the cradle in lowered position and showing how a typical boat is floated thereon in readiness for lifting.

Motorized means is provided for lifting and lowering the rear end of the boat cradle 12 out of and into the water W for raising and lowering a boat B (see broken line repesentation thereof in FIG. 3). For this purpose, an electric winch mechanism 56 is mounted upon the outwardly-extending wooden walk-way 21, for example, so that its coaxial, dual winding drums 57, 58 extend centrally of the I-beam members 14, 15 just to the rear of the transverse front I-beam member 16. Electric winch mechanism 56 comprises gear reduction device 59 the output shaft of which carries the winding drums 57, 58 to drive them at an appropriate speed for raising or lowering the boat cradle 12 as hereinafter appears. Winding drum 58 has attached thereto one end of a first control cable 60 which extends laterally to one side along the transverse front I-beam member 16 to the outer end thereof whereat it passes over a horizontally-journalled pulley sheave 61 whence it is redirected outwardly along I-beam member 15 at the inside thereof. As best illustrated in FIGS. 2 and 3, the cable 60 thence passes over a vertically-journalled pulley sheave 62 near the outer end of I-beam member 15 to be redirected substantially vertically downwardly to pass around pulley sheave 63 vertically journalled between a pair of laterally-spaced brackets 64, 65 (see FIG. 4) secured to and upstanding from a pair of spaced, parallel I-beams 66, 67, said I-beams being secured between the undersides of I-beam members 14, 15 near the outer ends thereof. The thus upwardly-directed run of the control cable 60 terminates at the inside of I-beam member 15, where it is affixed in outwardly-spaced relation with respect to pulley sheave 62, as indicated at 68. Winding drum 57 similarly has attached thereto one end of a second control cable **60*a*, which in a like manner extends along the inside of the opposite I-beam member 14 for simultaneously lifting the opposite side of the boat cradle 12. The cable guide mechanism associated with the second cable 60*a* is the same as that just described for the cable 60**, and is therefore not further described herein.

In use, the boat cradle 12 will be lowered into the water by switching on the electric winch mechanism 56 so that it turns in the proper direction for unwinding of the cables **60, 60*a*. As illustrated in FIG. 3, a boat B can then be floated upon the cradle and driven forwardly sufficiently to slide and rest lightly on chocks 27, 28 and 39. The guide post pairs 34, 35 and 44, 45, serve to facilitate straight-on loading of the boat B in cooperation with the above-described chocks and the bow stop member 49 as the boat is being propelled in place. Once the boat has been thus loaded and secured, if necessary by suitable bow lines or the like, the winch mechanism 56 can be energized to turn the winding drums 57, 58 in the opposite direction for retracting the cables 60, 60*a* and thereby lifting the cradle 12** together with the loaded boat B out of the water.

It will be understood that the turn-buckle 54 can be adjusted to raise or lower the pivoted front end of the boat cradle 12 to accommodate for change in height of the water level W as influenced by the tide, or, as in the case of inland waters, by seasonal and weather changes.

One advantage of the float-on boat docking and lifting assembly comprising the invention resides in the fact that, although simple and inexpensive in structure, it will handle boats up to about 36 feet in length, and operates to floaton load a boat and withdraw it completely out of the water in about 30 to 60 seconds. Besides being very fast in loading and unloading or launching, the boat lift also serves as an engine test stand for maintaining the engine in good working condition over long periods of boat dockage. Dockage can be effected without the need of mooring lines and the like, since the boat cradle completely contains the boat once it is placed in loaded position thereon.

Another advantage and salient feature of the invention resides in the fact that since it lacks overhead lifting structure, a boat having outriggers, radio antennae, convertible tops, and even a fly bridge can be loaded and lifted without the necessity of lowering any one of them, as is ordinarily required with overhead boat lift devices heretofore known.

Still another advantage of the invention resides in the fact that it will accommodate boats of up to 36 feet in length and weighing upwards of 20,000 pounds. Since such large boats are ordinarily too large to trailer and too large for drystack storage, they have heretofore been kept in the water, necessitating bottom scraping and painting two or three times a year. The drydocking of such boats with use of the float-on boat docking and lifting mechanism hereindescribed, moreover, eliminates the need for the daly pumping of bilage water during rainy seasons, and obviates the deteriorating effect on engines, electrical system, etc., of boats left in the water when not in use.

Although I have illustrated and described herein only one form in which my invention can be conveniently embodied in practice, it is to be understood that this embodiment is presented by way of example only, and not in a limiting sense. My invention, in brief, comprises all the embodiments and modifications coming within the scope and spirit of the following claims:

What I claim as new and desire to secure by Letters Patent is:

1. A float-on boat docking and lifting mechanism comprising, in combination, a cradle support framework having spaced, parallel, elongated members and being open at one end to permit entry of a water craft, means for supporting said framework members in a substantially common, horizntal plane and in vertical spaced relation above a body of water, an elongated float-on boat cradle between and below said framework members, means pivotally securing one end of said boat cradle at a central position between the other ends of said cradle support framework members at a location above the surface of the body of water, a reversible winch mechanism having a pair of axially aligned winding drums, means mounting said winch mechanism so that the axis of rotation of said winch drums is centrally located between said other ends of said framework members and extends longitudinally therebetween, a first cable means secured at one end to one of said winch drums, pulley sheave means directing said first cable for passage along one side of one of said framework members from said other end to said one end thereof, and means controlled by movement of said first cable means along said one of said framework members in one direction or the other, selectively, for raising or lowering the other end of said boat cradle.

2. A float-on boat docking and lifting mechanism as defined in claim 1 wherein said raising and lowering means comprises a pulley sheave journalled at one side of said boat cradle near the other end thereof, said first cable being looped under said pulley sheave and having its terminal end portion fixed with respect to said one end of said framework member.

3. A float-on boat docking and lifting mechanism as defined in claim 1, including a second cable means secured at one end to the other of said winch drums, pulley sheave means directing said second cable for passage along one side of the other of said framework members from said other end to said one end thereof, and means controlled by simultaneous movement of said first and second cable means along their respective framework members in one direction or the other for selectively raising and lowering the other end of said boat cradle.

4. A float-on boat docking and lifting mechanism as defined in claim 3, wherein said raising and lowering means comprises a first pulley sheave journalled at one side of said boat cradle near the other end thereof, said first cable being looped under said first pulley sheave and having its terminal end portion fixed with respect to one end of said first framework member, a second pulley sheave journalled at the other side of said boat cradle near the other end thereof, said second cable being looped under said second pulley sheave and having its terminal end portion fixed with respect to said one end of the other of said framework members.

5. A float-on boat docking and lifting mechanism as defined in claim 4, wherein said means pivotally securing said one end of said boat cradle comprises a turnbuckle.

6. A float-on boat docking and lifting mechanism as defined in claim 1, wherein said elongated float-on boat cradle comprises a pair of laterally-spaced, longitudinally-extending framework beams, said cradle framework beams being mutually convergent to meet at said one end of said boat cradle, and chock means between and along said cradle framework beams for the seating thereupon of a water craft to be raised and lowered by said cradle.

7. A float-on boat docking and lifting mechanism as defined in claim 6, incuding lateral guide means extending outwardly and upwardly of each side of said boat cradle to facilitate the loading and seating upon said boat cradle of a water craft preparatory to its being lifted out of the water.

8. A float-on boat docking and lifting mechanism as defined in claim 4, wherein said elongated float-on boat cradle comprises a pair of laterally-spaced, longitudinally-extending framework beams, said cradle framework beams being mutually convergent to meet at said one end of said boat cradle, and chock means between and along said cradle framework beams for the seating thereupon of a water craft to be raised and lowered by said cradle.

9. A float-on boat docking and lifting mechanism as defined in claim 8, including lateral guide means extending outwardly and upwardly of each side of said boat cradle to facilitate the loading and seating upon said boat cradle of a water craft preparatory to its being lifted out of the water.

10. A float-on boat docking and lifting mechanism as defined in claim 4, wherein said support framework further comprises a transverse framework member extending between said other ends of said framework members, said means pivotally securing said one end of said boat cradle comprising a turn-buckle secured between said transverse framework member and said one end of said boat cradle.

* * * * *